United States Patent [19]

Hagle

[11] Patent Number: 4,719,713

[45] Date of Patent: Jan. 19, 1988

[54] TRIGGER SAFETY STATUS SIGNALING DEVICE

[76] Inventor: Richard A. Hagle, 1494 Bucknell Way, Marietta, Ga. 30067

[21] Appl. No.: 9,742

[22] Filed: Feb. 2, 1987

[51] Int. Cl.[4] ..... F41C 17/02

[52] U.S. Cl. ..... 42/1.01; 42/70.06; 42/84

[58] Field of Search ..... 42/1.01, 70.07, 70.06, 42/70.01, 84

[56] References Cited

U.S. PATENT DOCUMENTS

| | | | |
|---|---|---|---|
| 666,405 | 1/1901 | Baggett | 42/1.01 |
| 2,134,406 | 10/1938 | Jacobs | 42/1.01 |
| 3,044,204 | 7/1962 | Zimmerman | 42/84 |

*Primary Examiner*—Deborah L. Kyle
*Assistant Examiner*—Michael J. Carone
*Attorney, Agent, or Firm*—Thomas & Kennedy

[57] ABSTRACT

A firearm trigger safety status signaling device includes electrically energizable audio and light signals that are mounted to a component of the trigger mechanism itself for actuation in response to movements of the trigger safety.

5 Claims, 6 Drawing Figures

TRIGGER SAFETY STATUS SIGNALING DEVICE

TECHNICAL FIELD

This invention relates generally to trigger safety devices for firearms, and particularly to devices for generating signals indicative of the operative status of trigger safeties.

BACKGROUND OF THE INVENTION

Firearms, such as shotguns, rifles and pistols, are commonly provided with a safety for use in preventing accidental actuation of a trigger. The safety is typically in the form of an elongated bar or button that is mounted to the trigger housing or guard. The safety is designed to be manually movable along a reciprocal path of travel between a safety-on position, where it stops and prevents the trigger from being moved to a fire position, and a safety-off position where it does not interfere with movement of the trigger to the fire position. In order to indicate the status of the safety, the safety often has a portion that is colored red which is exposed and observable whenever the safety is in the safety-off position. This serves as warning to the use of the firearm that the safety is off and the trigger enabled.

Heretofore, it has been recognized that passively observable warnings on firearm safeties such as color-coded signals may go unnoticed unless the firearm user actually looks at and observes the position of the safety switch. In order to provide an active warning signal, firearms have been equipped with luminous and audio signal means for generating a light and/or sound whenever the safety is in the safety-off position. Exemplary of such active safety status signaling devices are those shown in U.S. Pat. Nos. 66,405, 2,134,406 and 3,044,204.

To provide firearms with active signals has heretofore required that the firearms themselves be modified to a substantial extent. For example, firearms with active safety signaling devices have typically had cavities formed in their stocks in which a set of batteries are replacably housed. Channels communicate with these cavities through which wiring extends that couples the batteries with switch mechanisms actuated by the safety. The gun stocks have also been altered to provide audio or luminous signal means that are powered by the batteries and operated in response to the switching mechanism associated with the safety.

Firearms with active trigger safety status signal devices have not met with significant commercial success because of the extent of firearm modification required and due to the fact that they have been permanently incorporated whereby they are present whether or not the user desires such a feature. Accordingly, it would provide a distinct advance in the art where a trigger safety status signaling device devised that could be readily attached and detached from existing firearms in a simple and expedious manner and that would require minimal or no alteration of the firearm itself. Accordingly, it is to the provision of such a signaling device that the present invention is primarily directed.

SUMMARY OF THE INVENTION

In a preferred form of the invention, electrically powered signaling means is provided for a firearm of the type having a trigger mechanism that includes a trigger housing or guard, a trigger mounted to the trigger guard for movement between a cocked and a fire position, and a safety mounted to the trigger guard for movement between a safety-on position that prevents the trigger from being moved to the fire position and a safety-off position that permits the trigger to be moved to the fire position. The electrically powered signal means is mounted to a component of the trigger mechanism for actuation in response to movements of the safety.

In another form of the invention, a trigger safety status signaling device is provided for a firearm of the type having a trigger guard to which a trigger is mounted for movement between cocked and fire positions and to which a safety is mounted for reciprocal movement along a path of travel that extends through opposite sides of the trigger guard between safety-on and safety-off positions. The signal device includes a bifurcated housing comprised of a pair of housing members each of which is formed with an opening through which the safety may extend. Fastening means are included for attaching the housing members to the trigger guard so as to straddle the guard with the housing member openings aligned with the safety path of travel whereby the path of travel may extend into the housing through the openings with the housing attached to the trigger guard. Electric switch means are also included for coupling and decoupling the signal means with the battery in response to movements of the safety within the housing along the path of travel.

In yet another preferred form of the invention a trigger safety status signaling device is provided for a firearm of the type having a trigger guard to which a trigger is mounted for movement between cocked and fire positions and to which a safety is mounted for reciprocal movement along a path of travel between safety-on and safety-off positions at which the safety is releasibly held by detent means. The signal device comprises a battery and an electrically operable signal means mounted to the safety. Electrical switch means are mounted to the safety for actuation by the detent means in coupling and decoupling the signal means with the battery in response to movements of the safety.

DETAILED DESCRIPTION

Figure 1:
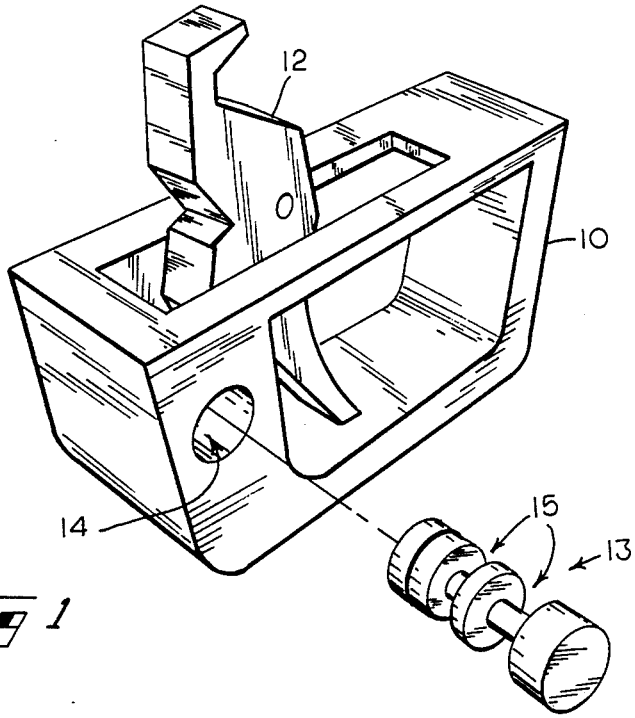
FIG. 1 is a perspective view of a firearm trigger mechanism of conventional structure with the mechanism safety shown exploded away from the trigger housing.

With reference next in more detail to the drawing, there is shown in FIG. 1 a trigger mechanism of conventional structure for a firearm which is seen to comprise a trigger guard and housing 10 to which a trigger 12 is pivotably mounted for clockwise movement, as viewed in FIG. 1, from a trigger cocked position to a trigger fire position. Here, the mechanism that is operated by the trigger 12 in actuating a firing pin or otherwise discharging the firearm is not shown but is of conventional structure. The trigger mechanism is seen to have a safety or safety switch, indicated generally at 13, which is mounted for sliding movement within a channel 14 formed in the trigger guard 10 rearwardly of the trigger 12. The safety 13 is generally in the shape of an elongaged pin of stepped, cylindrical shape that has two annular recesses or indentures 15 spaced therealong in which an unshown spring biased, detenting ball element may reside in holding the mechanism alternatively in a safety-on or safety-off position. When the safety switch 13 is in the safety-on position it is located so that its larger diameter surface stops and limits any clockwise movement of the trigger 12 from its cocked position and thereby prevent the trigger from actuating the associated firing mechanism. Conversely, when the safety is in its safety-off position the trigger may move within a recess 15 and activate the firing mechanism. The trigger mechanism and safety of FIG. 1 is thus of conventional structure.

Figure 2:
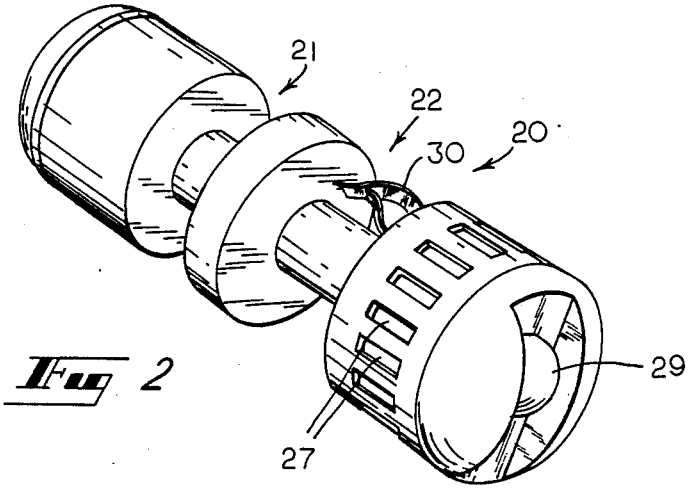
FIG. 2 is a perspective view of a firearm safety that incorporates a safety status signaling device of the present invention.
Figure 3:
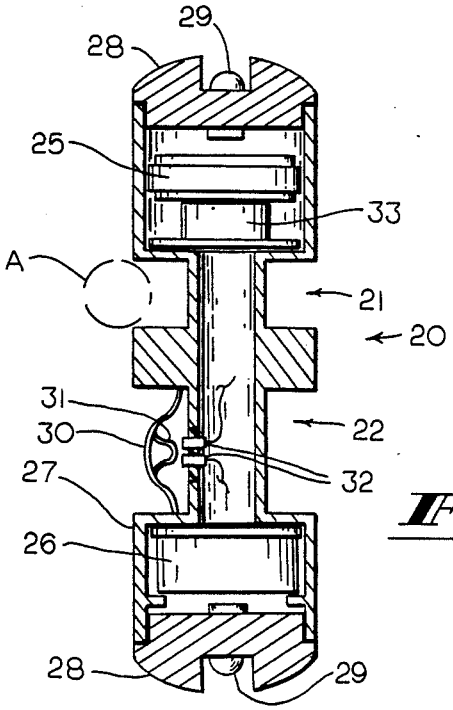
FIG. 3 is a cross-sectional view of the firearm safety signaling device illustrated in FIG. 2.

With reference next to FIGS. 2 and 3, a combination safety and safety status signaling device is shown at 20. The device has the same external shape as the conventional safety 13 of FIG. 1 in that it is of generally cylindrical shape and has two axially spaced recesses 21 and 22 in which a spring biased detent ball A may be positioned for releasibly holding the safety in one of two positions, as shown in FIG. 3. The device 20 here, however, is seen to be hollow and to house a battery 25 and a sound generator or speaker 26 which may generate audio signals that pass through an annular set of openings 27, as shown in FIG. 2, to ambience. The device has a tubular housing member 27 whose ends are closed by end caps 28 to each of which a light emitting diode 29 is mounted. The end caps are preferably removably mounted here so that they may be removed from time to time to access the interior. Thus, the battery 25 may be accessed for replacement, when needed.

Within the recess 22 is mounted a resilient, plastic strip 30 that is normally flexed outwardly as shown in the drawing. To the inner surface of the strip 30 that faces the axis of the safety is mounted a metallic and conductive contact element 31 adjacent two mutually spaced fixed contacts 32 that are rigidly mounted to the safety. With this construction it is seen that should the strip 30 be depressed, toward the fixed contacts, the movable contact 31 will be brought into direct engagement with the pair of fixed contacts 32 thereby electrically bridging them. When an external depressing force is romoved from the strip 30, it springs back to its normal position illustrated in FIGS. 2 and 3 thereby bringing the movable contact 32 away from the fixed contacts whereupon the fixed contacts are no longer electrically shorted. The elements 30, 31 and 32 thus form an electric switch which is actuated by movements of the flexible member 30 to and away from the axis of the safety.

Figure 6:
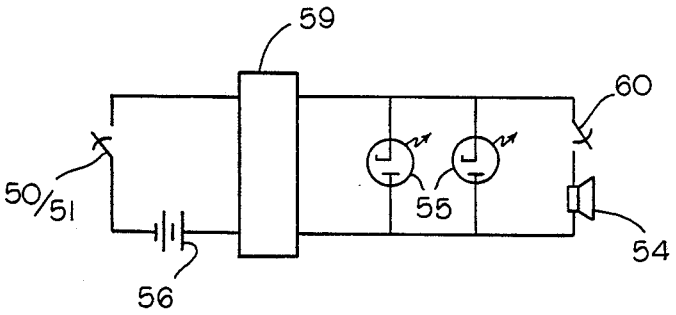
FIG. 6 is a schematic diagram of the electrical circuitry of the signaling device illustrated in FIG. 5.

For clarity of illustration electrical wiring is not shown in FIG. 3. However, the circuit is schematically illustrated in FIG. 6 with the exception of the absence of an auxiliary switch 60. Thus, the speaker 26 and the two light emitting diodes 29 are coupled to the battery 25 and thereby energized upon the closure of the switch by the engagement of movable contact 31 to the pair of fixed contacts 32. This is done via a conventional clock 33 which is employed in the circuit to cause the light and audio signals to operate intermittently.

A firearm may be manufactured with the combination safety and signal device illustrated in FIGS. 2 and 3. Alternatively, the device may be substituted for the conventional safety 13 is an existing firearm. Once mounted to the trigger guard housing 10 the dimensions of the safety are such that at least one end will protrude out from a side of the housing. In its safety-on position the safety is located within the trigger housing so that the detent ball A, shown in FIG. 3, is located as shown so that it is not in engagement with the strip 30. Thus, in this position the electric switch is open and audio and luminesent signaling means inoperative as not connected with the battery 25. Once the safety is slid within the housing by manually urging an exposed end inwardly, the safety is repositioned so that the detent A becomes now located within the bounds of recess 22 in direct contact with the resilient strip 30 causing it to be depressed so that movable contact 31 is in direct bridging engagement with the fixed contacts 32. In this safety-off position the speaker 25 and the light emitting diodes 29 are coupled across the battery and thus are intermittently emitting signals. In this mode it will be seen that a light will be flashing from opposite ends of the safety as well as a sound being emitted. If desired, an auxiliary switch may be employed here, as shown by switch 60 in the schematic diagram of FIG. 6, to disable the audio, where desired. Upon the safety being removed back to its safety-on position the electrical switch opens and thereby decoupling the speaker and the light emitting diodes from the battery thereby terminating their operations.

Figure 4:
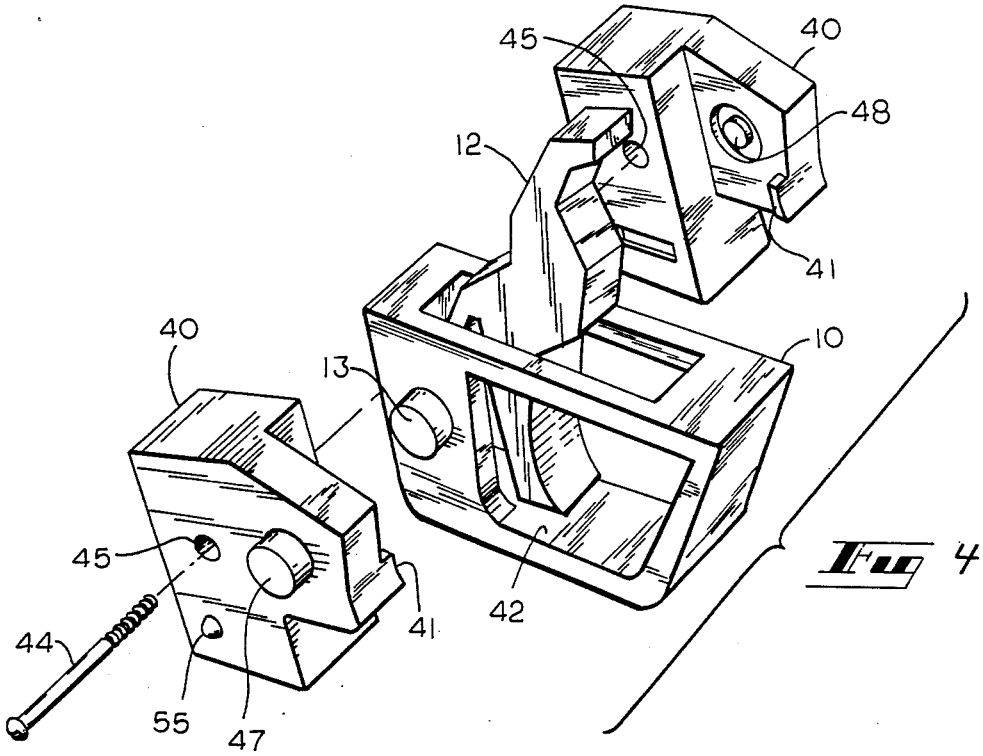
FIG. 4 is a perspective view of the conventional trigger mechanism shown in FIG. 1 together with a safety status signaling device shown in a position preparatory to mounting to the trigger mechanism which device embodies principles of the present invention in an alternative form.
Figure 5:
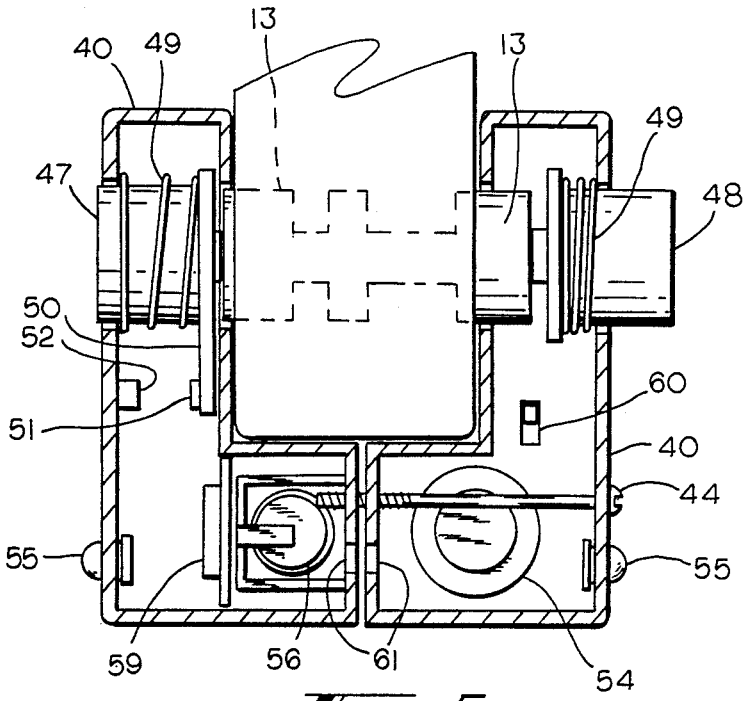
FIG. 5 is a cross-sectional view of the safety status signaling device of FIG. 4 shown mounted to the trigger mechanism.

With reference next to FIGS. 4 and 5, the trigger mechanism shown in FIG. 1 comprised of the housing 10, trigger 12 and safety 13 are shown with none of these components in an altered configuration, not even the safety itself. In this embodiment the audio and light signaling means, indicative of the status of the safety, is mounted and dismounted directly to the conventional trigger mechanism itself. Here, the trigger safety status signaling device is comprised of a housing which is bifurcated into two independent housing members 40 that are of a size and shape adapted to be placed against opposite sides of the housing 10 in intimate contact therewith and with a step 41 supported upon a floor 42 of the guard located beneath the trigger 12. A screw 44 may then be threaded through aligned holes 45 in the housing in securing rear portions of the housing members tightly together.

The signaling device is further seen to include a button 47 mounted in one of the housing members and another button 48 mounted in the other housing member which extend through openings in the housing members and into direct contact with opposite ends of the conventional safety 13. These buttons are held against the safety by means of compression springs 49. The button 47 has a dependent arm 50 mounted thereto which carries a movable switch contact 51. This contact is positioned adjacent a fixed contact 52 that is mounted to an inside wall of the housing. Thus, movements of the button 47 serve to bring the contacts 50 and 51 into and out of direct engagement whereby they act as an electrical switch. A speaker 54 and two light emitting diodes 55 are also mounted to the housing and electrically coupled to a battery 56 by the switch formed by the contacts 50/51. A clock 59 and an auxiliary switch 60 are also provided. The electrical wiring that connects the various components of the electrical circuit together is shown only schematically in FIG. 6 but does extend between the two bifurcated housing members by passing through two aligned holes 61 formed in the housings.

For operation the buttons 47 and 48 esentially provide extensions of the conventional safety 13 such that manual actuations of them serve to actuate the conventional safety 13 itself in performing its standard operation of limiting and not limiting movements of the trigger 12. In FIG. 5 the safety is in its safety-on position. In this mode the electric switch provided by contacts 50/51 is open thereby decoupling the audio and visual signaling means provided by the speaker and light emitting diodes from the battery 56. Upon movement of button 48 to the left, as shown in FIG. 5, the safety 13 is urged to a safety-off position and the contacts 50/51 are brought into engagement thereby coupling the signaling means with the battery and actuating them. In this position the light emitting diodes 55 and the speaker emit warning signals that the safety is in its off position. In the event it should become desired to disable the speaker, such may be done by the actuation of an auxiliary switch 60 to its open position, as shown in FIG. 6. In the event it should become desirable to remove the signal device from the firearm, this may simply be done by removing the screw 44 whereupon the housing components and associated signaling means and circuitry are removed leaving the conventional trigger mechanism in place.

It thus is seen that a trigger safety status signaling device is provided which may be easily mounted and dismounted to a firearm in a manner that overcomes deficiencies of those of the prior art. It should be understood, however, that the just described embodiments merely illustrate principles of the invention in two preferred forms. Many modifications, additions and deletions may, of course, be made thereto without departure from the spirit and scope of the invention as set forth in the following claims.

I claim:

1. A trigger safety status signal device for a firearm of the type having a trigger guard to which a trigger is mounted for movement between cocked and fire positions and to which a safety is mounted for reciprocal movement along a path of travel that extends through opposite sides of the trigger guard between safety-on and safety-off positions, and with the device comprising a bifurcated housing comprised of a pair of housing members each formed with an opening through which the safety may extend; fastening means for attaching said housing members to said trigger guard so as to straddle said guard with said housing member openings aligned with the safety path of travel whereby the path of travel may extend into said housing through said openings; a battery and an electrically operable signal means mounted in said housing, and electric switch means for coupling and decoupling said signal means with said battery in response to movements of the safety within said housing along the path of travel.

2. The trigger safety status signal device of claim 1 wherein each of said housing members is formed with a second opening in which a push-button is movably mounted for actuation of the safety.

3. The trigger safety status signal device of claim 2 wherein said push-buttons are spring-biased against opposite ends of the safety.

4. The trigger safety status signal device of claim 2 where said electric switch means includes one switch contact mounted on the inside of one of said housing members and another switch control mounted on one of said push-buttons for movement into and out of engagement with said one contact.

5. A trigger safety status signal device for a firearm of the type having a trigger guard to which a trigger is mounted for movement between cocked and fire positions and to which a safety is mounted for reciprocal movement along a path of travel between safety-on and safety-off positions at which the safety is releasibly held by detent means, and with the signal device comprising a battery and an electrically operable signal means mounted on the safety for actuation by the detent means in coupling and decoupling said signal means with said battery in response to movments of the safety, said switch means comprising a pair of fixed contacts fixedly mounted on said safety and a movable contact movably mounted on said safety for movement between a position spaced from said pair of fixed contacts and a position in bridging contact with said pair of fixed contacts.

* * * * *